US005610582A

United States Patent [19]

Zahn, Jr. et al.

[11] Patent Number: 5,610,582

[45] Date of Patent: Mar. 11, 1997

[54] ALARM SCREEN WITH BUILT-IN BATTERY OPERATED SOUNDING UNIT

[75] Inventors: Richard A. Zahn, Jr., Ft. Lauderdale; Merle L. Stepp, Coral Springs, both of Fla.

[73] Assignee: Security Screens, Inc., Hollywood, Fla.

[21] Appl. No.: 387,318

[22] Filed: Feb. 13, 1995

[51] Int. Cl.[6] ..... G08B 13/08

[52] U.S. Cl. ..... 340/550; 340/689; 340/693

[58] Field of Search ..... 340/550, 689, 340/693; 200/61.47, 61.52

[56] References Cited

U.S. PATENT DOCUMENTS

| | | | |
|---|---|---|---|
| 535,100 | 3/1895 | Gill | 340/550 |
| 585,171 | 6/1897 | Arnold | 340/550 X |
| 1,452,500 | 4/1923 | Galerman | 340/550 X |
| 1,630,808 | 5/1927 | Siegerdt | 340/550 X |
| 1,712,771 | 5/1929 | Kohler | 340/550 X |
| 3,051,935 | 8/1962 | Willson | 340/550 |
| 3,696,373 | 10/1972 | Dunn et al. | 340/550 X |
| 3,725,891 | 4/1973 | Miller | 340/550 |
| 4,146,293 | 3/1979 | Mutton et al. | 340/550 |
| 4,232,310 | 11/1980 | Wilson | 340/550 |
| 4,293,778 | 10/1981 | Williams | 340/550 X |
| 4,814,750 | 3/1989 | Abramson | 340/550 |
| 4,843,375 | 6/1989 | Riordan | 340/550 |
| 5,005,000 | 4/1991 | Riordan | 340/550 |

*Primary Examiner*—Thomas Mullen

*Attorney, Agent, or Firm*—Oltman, Flynn & Kubler

[57] ABSTRACT

A self-contained alarm screen apparatus for securing building openings against intruders includes a screen sheet having a screen peripheral edge, a frame secured to the screen peripheral edge for providing structural support to the screen sheet, a conductive detection wire secured across the screen sheet for detecting a breach in the screen sheet, terminals for connecting to the detection wire, alarm elements including an electric power source, an alarm sounder, and an alarm circuit for carrying electric power from the power source to the alarm sounder, and an element mounting structure for mounting the alarm elements to the frame. The alarm elements are preferably joined together by a joining structure to form an alarm module, and the element mounting structure preferably includes a module mounting structure for mounting the module to the frame, and a module connector for connecting the module to the module mounting structure. The module connector preferably removably connects the module to the module mounting structure. The module mounting structure preferably includes a module mounting plate secured to the frame. The terminals are preferably attached to the mounting plate.

11 Claims, 3 Drawing Sheets

ALARM SCREEN WITH BUILT-IN BATTERY OPERATED SOUNDING UNIT

BACKGROUND OF THE INVENTION

1. Field of the Invention

The present invention relates generally to the field of alarm systems for securing building openings including doors and windows. More specifically it relates to a self-contained screen alarm apparatus which mounts as a complete, single unit within a building opening in place of a conventional screen. The screen alarm apparatus provides the same barrier against insect entry afforded by conventional screens, but also sounds an alarm if the screen is ripped apart or pulled out of the building opening. The apparatus includes a screen and frame of ordinary design where the edges of the screen are fitted into a spline channel in the frame, and a rubber spline member is pressed into the spline channel to hold the screen edges in place. The apparatus adds to this construction a loop of current carrying wire woven through the screen wire in an elongated sine wave pattern extending from the top to the bottom of the screen. The ends of this detection wire are connected to terminals on a detection and sounder assembly secured within a corner of the screen frame. Breakage of the detection wire activates an alarm within the detection and sounder assembly. The assembly includes a triangular mounting plate secured in a corner of the screen frame and an assembly module which removably attaches to the plate. The two detection wire terminals are attached to the plate. The module contains a battery, a tilt switch, internal and external combination switches, a circuit board, an alarm sounder and interconnecting module circuitry. The alarm sounder is activated by either a discontinuity in the detection wire or by tilt of the apparatus substantially out of the vertical plane, thereby opening the tilt switch. Once activated the alarm sounder is locked in an activated mode until deactivated by the apparatus user.

2. Description of the Prior Art

There have long been alarm systems and devices for securing doors and windows of buildings against unwanted entry.

Riordan, U.S. Pat. No. 5,005,000, issued on Apr. 2, 1991, discloses an alarm screen kit. The Riordan kit includes a sheet of nonconductive screen mesh, a conductive detection wire for interweaving into the screen mesh and framing members for securing the edges of screen mesh. These parts are provided disassembled in a tubular container. The installation procedure includes the step of electrically coupling the detection wire to a separate alarm device. A problem with Riordan is that installation requires a technical knowledge sufficient to connect the wiring between the screen and the alarm device, as well as to assemble the remainder of the kit. Another problem with Riordan is that, since the power source and sounding element are separate from the screen structure, alarm disconnection and deactivation are a serious risk.

Abramson, U.S. Pat. No. 4,814,750, issued on Mar. 21, 1989, reveals a window screen alarm. Abramson includes a screen mesh having an interwoven detection wire connected to a separate alarm speaker and an optional separate alarm light. A magnetic sensor is provided the edge of the screen frame to activate the alarm upon removal of the screen from the frame. Williams, U.S. Pat. No. 4,293,778, issued on Oct. 6, 1981, teaches an anti-theft screen construction substantially similar to that of Abramson. A reed switch is provided at the screen periphery which is activated by a magnet mounted to the window frame adjacent the reed switch. The problems of Riordan are presented by Abramson and Williams.

Mutton, et al., U.S. Pat. No. 4,146,293, issued on Mar. 27, 1979, discloses an entry detection screen. For one embodiment of Mutton, et al., double wires are woven through the screen and connected to two series circuits. The double wires may be twisted to make tracing the individual circuits difficult for an intruder. The wires connect to a separate alarm sounding device. The problems of Riordan are again presented.

Dunn, et al., U.S. Pat. No. 3,696,373, issued on Oct. 3, 1972, reveals an electric alarm screen. The Dunn et al. screen detection circuit is made up of clusters of conductive detection wires passing together between alternating conductive plates secured to the screen frame. The alarm device and detectors are separate from the screen, and the screen of one window is wired to the screen of the next window. Dunn et al. presents the problems of Riordan, in addition to the problems of complexity, bulk and substantial expense to manufacture.

Willson, U.S. Pat. No. 3,051,935, issued on Aug. 28, 1962, teaches a protective screen having a detection wire circuit woven through it. Contact points in electrical communication with the detection wire are provided at the edge of the frame for connection together in pairs through a conducting bar mounted on the building structure. An separate alarm circuit is activated when the detection wire circuit is opened. The problems of Riordan are presented.

Kohler, U.S. Pat. No. 1,712,771, issued on May 14, 1929, discloses a double screen burglar alarm. An electrically insulated frame is provided having frame members about one quarter inch thick. A conductive screen is secured to each side of the frame, so that the two screens are separated about one quarter inch. Each screen is wired to an alarm circuit, so that bringing the screens into contact, such as by pressing against one screen so that it touches the other, activates the alarm circuit. A problem with Kohler is that the apparatus requires two screen sheets, substantially increasing the cost. Another problem is that one who is not an intruder may simply touch the screen in an inquisitive manner and activate the alarm. Children may do so for their amusement. And, once again, the problems of Riordan are presented.

Siegerdt, U.S. Pat. No. 1,630,808, issued on May 31, 1927, reveals an alarm device to keep children from falling out of windows of apartments. Siegerdt employs the double screen design of Kohler, except that the second screen fits into a recess in the frame. The problems of Kohler are again presented.

Galerman, U.S. Pat. No. 1,452,500, issued on Apr. 24, 1923, discloses a burglar alarm apparatus. Galerman substantially includes a typical insect screen and detection wire arrangement. Opposing poles of a battery are connected to two wires, and contact of these two wires activates the alarm. These two wires are separated by push buttons and are bent into a number of convolutions to cover a window sash or similar structure. An attempt to break the window is said to bring these two wires into contact to sound the alarm. Galerman presents the problems of Riordan, in addition to being primitive and complex.

Arnold, U.S. Pat. No. 585,171, issued on Jun. 29, 1897, teaches a burglar alarm system. Arnold includes a sliding cover adapted to be placed over a building opening. The cover has a mounting which permits ready removal of the cover from its normal place. A circuit closing device is adapted to be operated by the cover when the cover is shifted from its normal plane, to activate a burglar alarm. A problem with Arnold is that it is very complex and primitive. Arnold also presents the problems of Riordan.

Gill, U.S. Pat. No. 535,100, issued on Mar. 5, 1895, teaches a burglar alarm for glass doors. A conductive film or strip is bonded to the glass along the window periphery and connects at two ends to an external alarm device. Gill presents the problems of Riordan in addition to being poorly suited to screen adaptations. A conductor along the periphery of a screen would not necessarily detect a tear in the middle of the screen.

It is thus an object of the present invention to provide a building opening screen alarm apparatus which is entirely self-contained, so that it does not rely on external power sources or an external apparatus.

It is another object of the present invention to provide such an apparatus which is installed in the same manner as a conventional framed screen is installed into a window opening thus requiring no special effort, skills or tools, and which stacks in storage as compactly as conventional framed screens.

It is still another object of the present invention to provide such an apparatus in which the electronic elements are contained within a conveniently removable module which can be sent away for repairs while the screen remains installed in the building opening, continuing to serve as an insect barrier.

It is finally an object of the present invention to provide such an apparatus which is universally adaptable, fitting into virtually any preexisting screen mounting structure, and into which a preexisting screen can be adapted by merely adding the detection wire, the mounting plate and the module.

SUMMARY OF THE INVENTION

The present invention accomplishes the above-stated objectives, as well as others, as may be determined by a fair reading and interpretation of the entire specification.

A self-contained alarm screen apparatus is provided for securing building openings against intruders, including a screen sheet having a screen peripheral edge, a frame secured to the screen peripheral edge for providing structural support to the screen sheet, a conductive detection wire secured across the screen sheet for detecting a breach in the screen sheet, terminals for connecting to the detection wire, alarm elements including an electric power source, an alarm sounder, and an alarm circuit for carrying electric power from the power source to the alarm sounder, and an element mounting structure for mounting the alarm elements to the frame. The alarm elements are preferably joined together by a joining structure to form an alarm module, and the element mounting structure preferably includes a module mounting structure for mounting the module to the frame, and a module connector for connecting the module to the module mounting structure. The module connector preferably removably connects the module to the module mounting structure. The module mounting structure preferably includes a module mounting plate secured to the frame. The terminals are preferably attached to the mounting plate.

The frame preferably includes a frame channel for receiving the screen peripheral edge and for receiving a first spline for securing the screen peripheral edge, and the mounting plate preferably includes a foot portion for insertion into the frame channel with the screen peripheral edge to be secured within the channel with the first spline for anchoring the mounting plate to the frame, a second spline, and a plate channel for receiving a segment of the screen peripheral edge and for receiving the second spline. The alarm circuit optionally additionally includes a tilt activated switch for activating the alarm circuit when the apparatus is tilted for sensing unauthorized removal of the apparatus from the building opening, and the tilt switch is preferably a mercury tilt switch. The alarm circuit optionally additionally includes an inner combination switch mounted within the module which is set by the apparatus user to a given combination, and an outer combination switch mounted outside the module which deactivates the alarm circuit when set with a combination matching the given combination and which arms the alarm circuit when set with a combination not matching the given combination. The alarm circuit also alternatively includes a key operated switch for activating and deactivating the alarm circuit.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
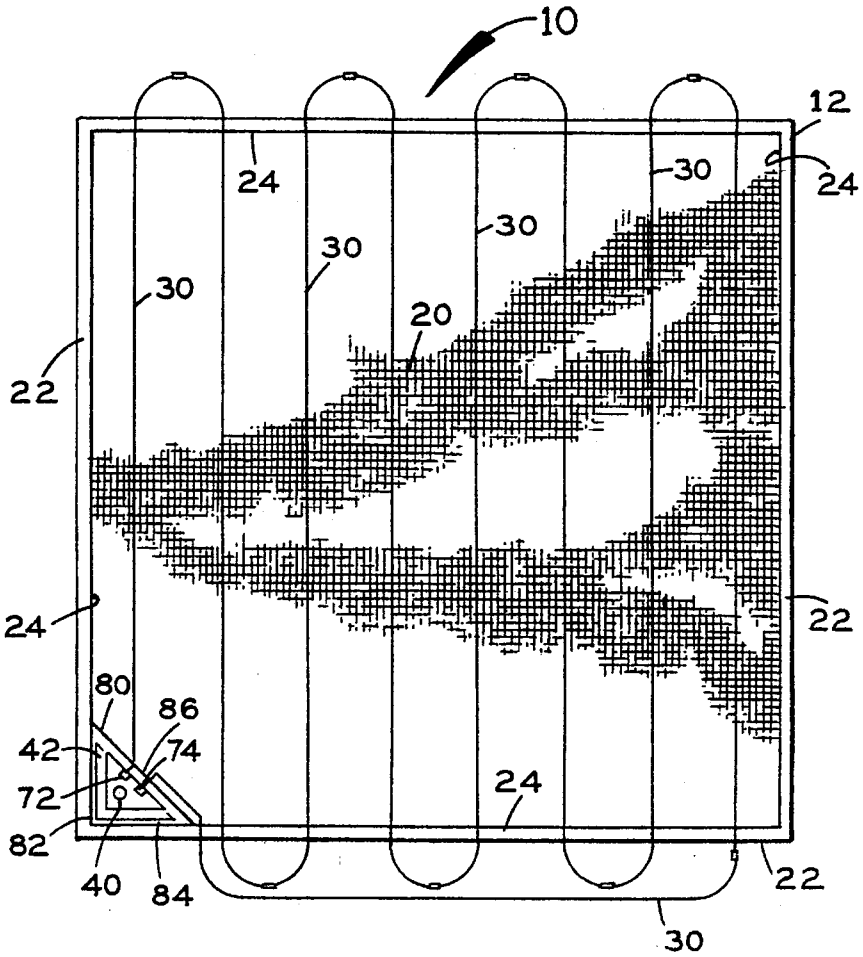
FIG. 1 is a schematic view of the apparatus showing the screen sheet, frame and module mounting plate, and the general detection wiring scheme. The detection wire does not actually extend beyond the frame, and is shown that way in this FIGURE only for visual clarity.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
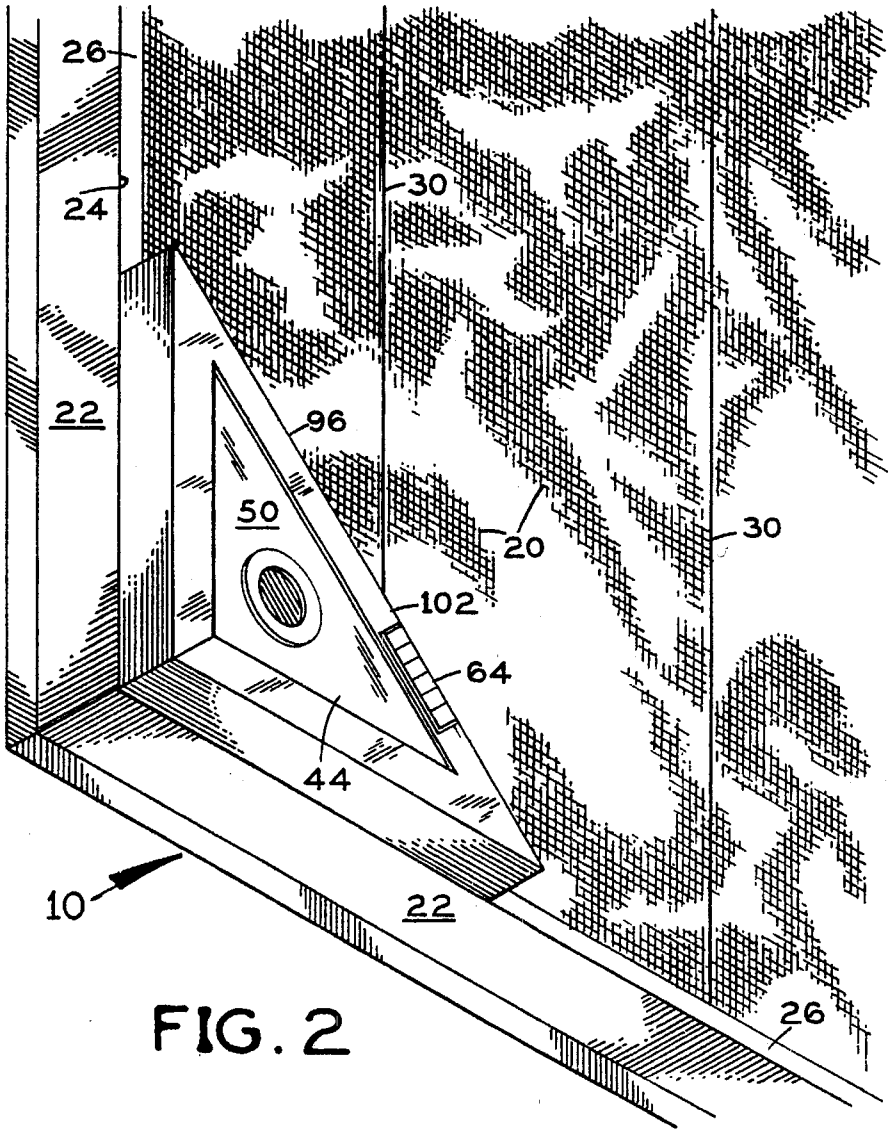
FIG. 2 is a close-up perspective view of the module mounted in a corner of the screen frame, also showing parallel segments of detection wire woven through the screen sheet. These wire segments are connected by perpendicular segments immediately adjacent to or within the screen frame to form a single continuous strand of detection wire.
Figure 4:
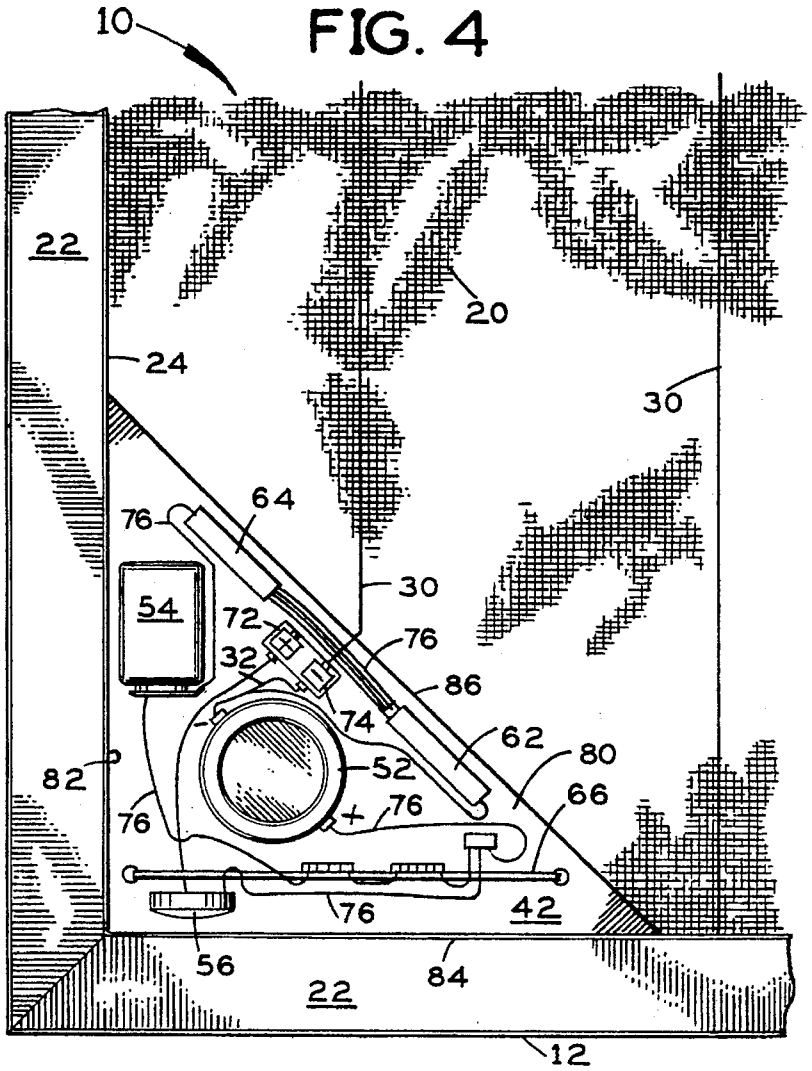
FIG. 4 is a view as in FIG. 2 with the shell of the module removed to expose the various alarm elements.
Figure 3:
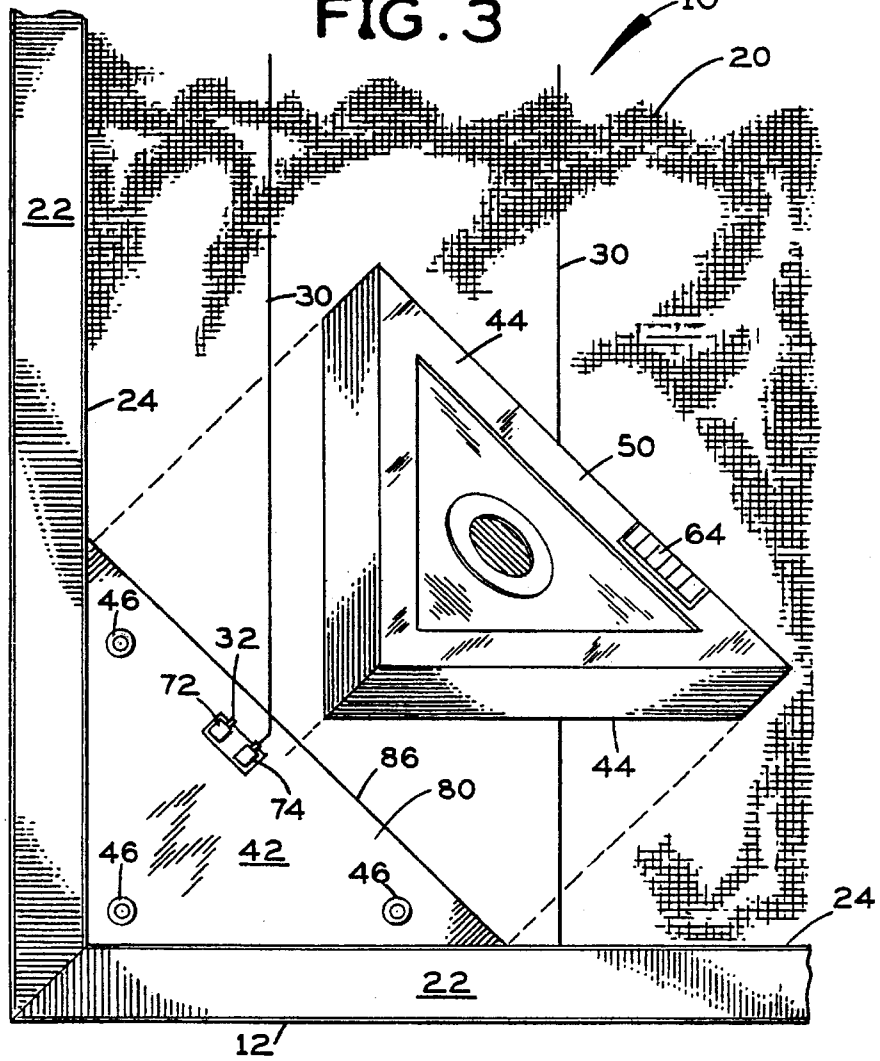
FIG. 3 is a view as in FIG. 2, with the screen sheet omitted and the module lifted away to reveal the module mounting plate, mounting screws and detection wire terminals.
Figure 5:
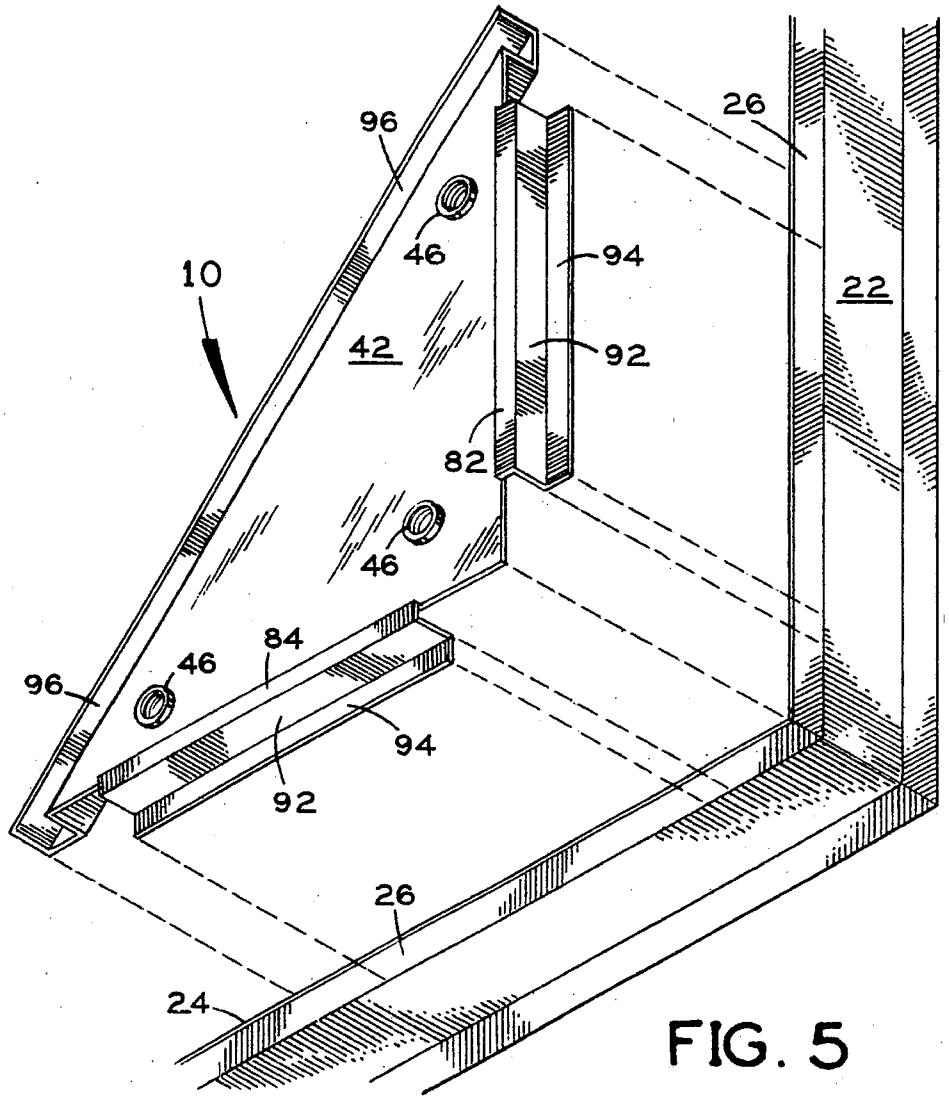
FIG. 5 is an exploded view of the module mounting plate and the plate foot portions aligned to be mounted at a screen frame corner.
Figure 6:
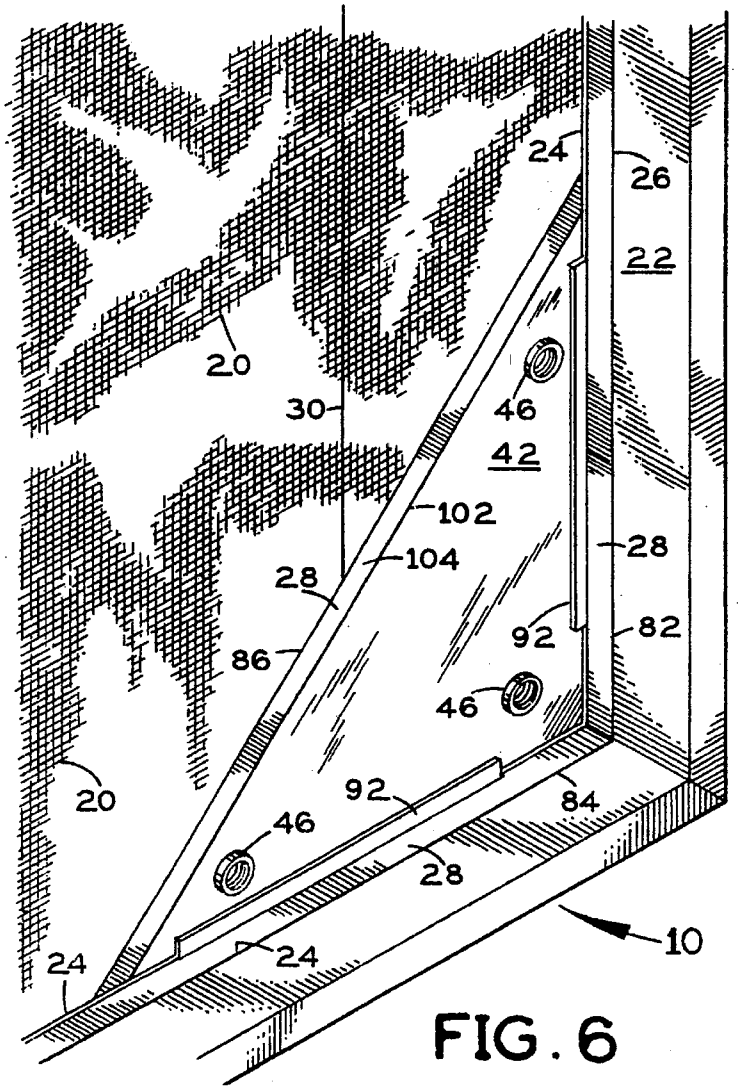
FIG. 6 is a view as in FIG. 5 with the mounting plate connected to the screen frame.

Referring to FIGS. 1–6, a self-contained screen alarm apparatus 10 is disclosed for securing a building opening 12 such as a window or a door against unwanted entry. Apparatus 10 replaces a conventional framed screen, while maintaining the same insect barrier function provided by the conventional screen. Yet apparatus 10 provides the additional function of sounding an alarm when ripped open or when pulled out of the building opening 12.

Apparatus 10 includes a sheet of screen 20 and a frame 22 of ordinary design where the edges 24 of screen 20 are fitted into a frame spline channel 26 in frame 22. A rubber or other suitable frame spline strip 28 is pressed into frame spline channel 26 to hold the screen edges 24 in place. Apparatus 10 adds to this construction a loop of current carrying detection wire 30 woven through the screen 20 strands or filaments in the pattern of a high amplitude, square sine wave swinging from the top to the bottom of the screen 20. See FIGS. 1 and 2. The two ends 32 of detection wire 30 are connected to an intruder detection and alarm sounder assembly 40 secured within a corner of screen frame 22.

Assembly 40 preferably includes a triangular mounting plate 42 secured in one corner of frame 22 and an assembly module 50. Module 50 removably attaches to plate 42 with module securing studs or screws 46. See FIG. 3. Plate 42 includes two detection wire 30 connection terminals 72 and 74. Module 50 includes a concave module shell 44 containing an alarm sounder 52, a battery 54, a tilt switch 56, internal and external combination switches 62 and 64, respectively, a circuit board 66, all secured to the inner surface of shell 44, and interconnecting module circuitry 76. See FIG. 4. Alarm sounder 52 is activated by either a discontinuity in detection wire 30 or by tilting apparatus 10 and thereby opening tilt switch 56. Once activated, sounder 52 is locked in an activated mode until deactivated by the apparatus 10 user.

Internal combination switch 62 and external combination switch 64 are both set to a given combination by the user. Then, once apparatus 10 is installed in a building opening 12, the external combination switch 64 combination is scrambled by the user. The difference in switch 62 and 64 combinations arms apparatus 10. If detection wire 30 is broken or apparatus 10 is tilted such as during cutting or removal by an intruder, alarm sounder 52 sounds, and continues to sound until the user easily resets the external combination switch 64 combination to match the internal combination switch 62 combination. An intruder cannot easily reset internal combination switch 62 because module 50 is fastened to plate 42 and held closed by screws 46.

Plate 42 includes a mounting face 80 and three plate edges, 82, 84 and 86, two of which, edges 82 and 84, are mutually perpendicular. See FIGS. 5 and 6. Edges 82 and 84 each have spline channel feet 92. Feet 92, which are essentially perpendicular tabs having perpendicular base portions 94, are fit into screen frame spline channel 26 during screen 20 and frame 22 manufacture. Spline strip 28 fits into channel 26 and over base portions 94 in the bottom of channel 26 to hold plate 42 mounted at an inside corner of screen frame 22. A plate spline channel 96 is provided along third edge 86 of plate 42 in mounting face 80. A corresponding corner of screen 20 is cut away to make room for plate 42. The cut edge 102 of screen 20 is fit into plate spline channel 96 and a segment of spline strip 104 is pressed into channel 96 to secure cut edge 102.

Equivalently, a key operated turn switch or a pull set pin switch may activate and deactivate alarm sounder 52 in place of combination switches 62 and 64. Tilt switch 56 may be a mercury switch or a reed switch. Apparatus 10 is optionally connected to a comprehensive building alarm system, although separate use is contemplated primarily. Screen 20 filaments may be aluminum or fiberglass. Detection wires 30 are preferably insulated where fiberglass screen 20 filaments is used, and are necessarily insulated where conductive screen 20 is used. Some elements or the module as a whole may be secured to the screen 20 rather than to the frame 22.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A self-contained alarm screen apparatus for securing building openings against intruders, comprising:

a screen sheet having a screen peripheral edge, frame means secured to said screen peripheral edge for providing structural support to said screen sheet, a conductive detection wire secured across said screen sheet for detecting a breach in said screen sheet, terminal means for connecting to said detection wire, alarm elements comprising an electric power source, an alarm sounder, and alarm circuit means for carrying electric power from said power source to said alarm sounder, and element mounting means for mounting at least one of said alarm elements to said frame means, wherein said alarm elements are joined together by a joining structure to form an alarm module, and wherein said element mounting means comprises module mounting means for mounting said module to said frame means, and module connecting means for connecting said module to said module mounting means.

2. An apparatus according to claim 1, wherein said module connecting means removably connects said module to said module mounting means.

3. An apparatus according to claim 1, wherein said module mounting means comprises a module mounting plate secured to said frame means.

4. An apparatus according to claim 3, wherein said terminal means are attached to said mounting plate.

5. An apparatus according to claim 3, wherein said frame means comprises a frame channel for receiving said screen peripheral edge and for receiving first spline means for securing said screen peripheral edge, wherein said mounting plate comprises:

a foot portion for insertion into said frame channel with said screen peripheral edge to be secured within said frame channel with said first spline means for anchoring said mounting plate to said frame means, second spline means, a plate channel for receiving a segment of said screen peripheral edge and for receiving said second spline means.

6. An apparatus according to claim 1, wherein said alarm circuit means additionally comprises a tilt activated switch for activating said alarm circuit when said apparatus is tilted for sensing unauthorized removal of said apparatus from said building opening.

7. An apparatus according to claim 6 wherein said tilt switch is a mercury tilt switch.

8. An apparatus according to claim 1, wherein said alarm circuit means additionally comprises:

an inner combination switch mounted within said module which is set by the apparatus user to a given combination, an outer combination switch mounted outside said module which deactivates the alarm circuit when set with a combination matching said given combination and which arms said alarm circuit when set with a combination not matching said given combination.

9. An apparatus according to claim 1, wherein said alarm circuit means additionally comprises:

a key operated switch for activating and deactivating said alarm circuit means.

10. An apparatus according to claim 1, wherein said alarm circuit means additionally comprises:

a pull set pin switch for activating and deactivating said alarm circuit means.

11. A self-contained alarm screen apparatus for securing building openings against intruders, comprising:

a screen sheet having a screen peripheral edge, frame means secured to said screen peripheral edge for providing structural support to said screen sheet, a conductive detection wire secured across said screen sheet for detecting a breach in said screen sheet, terminal means for connecting to said detection wire, alarm elements comprising an electric power source, an alarm sounder, and alarm circuit means for carrying electric power from said power source to said alarm sounder, and element mounting means for mounting at least one of said alarm elements to said screen sheet.

* * * * *